United States Patent [19]

Hartman et al.

[11] Patent Number: 4,704,233

[45] Date of Patent: Nov. 3, 1987

[54] DETERGENT COMPOSITIONS CONTAINING ETHYLENEDIAMINE-N,N'-DISUCCINIC ACID

[75] Inventors: Frederick A. Hartman; Christopher M. Perkins, both of Cincinnati, Ohio

[73] Assignee: The Procter & Gamble Company, Cincinnati, Ohio

[21] Appl. No.: 929,549

[22] Filed: Nov. 10, 1986

[51] Int. Cl.[4] ..... C11D 1/10; C11D 3/33

[52] U.S. Cl. ..... 252/527; 252/531; 252/532; 252/539; 252/540; 252/550; 252/551; 252/558; 252/559; 252/DIG. 11; 252/DIG. 14

[58] Field of Search ..... 252/527, 545, 531, 532, 252/539, 540, 550, 551, 558, 559, DIG. 11, DIG. 14

[56] References Cited

U.S. PATENT DOCUMENTS

| | | | |
|---|---|---|---|
| 3,151,084 | 9/1964 | Schlitz et al. | 252/137 |
| 3,158,635 | 11/1964 | Kezerian et al. | 260/429 |
| 3,920,564 | 11/1975 | Grecsek | 252/875 |
| 4,349,447 | 9/1982 | Noguchi et al. | 252/117 |
| 4,397,776 | 8/1983 | Ward | 252/527 |
| 4,412,943 | 11/1983 | Hirota et al. | 252/546 |
| 4,486,339 | 12/1984 | Young | 252/546 |
| 4,507,219 | 3/1985 | Hughes | 252/118 |
| 4,560,492 | 12/1985 | Curry et al. | 252/110 |

FOREIGN PATENT DOCUMENTS

| | | |
|---|---|---|
| 1037816 | 9/1978 | Canada . |
| 1439518 | 6/1976 | United Kingdom . |

OTHER PUBLICATIONS

Pavelcik and Majer "New Complexanes XXXIV, Ethylenediamine-N,N'-disuccinic Acid" Chem. Zvesti 32(1) 37-41 (1978).

*Primary Examiner*—Prince E. Willis
*Attorney, Agent, or Firm*—Bart S. Hersko; Steven J. Goldstein; Jerry J. Yetter

[57] ABSTRACT

Laundry detergent compositions containing a detergent surfactant, a detergent builder, and from about 0.1% to about 10% by weight ethylenediamine-N,N'-disuccinic acid or salts thereof are disclosed. These compositions provide enhanced removal of organic stains, such as food and beverage stains.

24 Claims, No Drawings

DETERGENT COMPOSITIONS CONTAINING ETHYLENEDIAMINE-N,N'-DISUCCINIC ACID

TECHNICAL FIELD

The present invention to improved laundry detergent compositions. Specifically, it relates to laundry detergent compositions containing ethylenediamine-N,N'-disuccinic acid (EDDS), a nil-phosphorous, biodegradable chelant, which assists in the removal of food, beverage, and certain other organic stains from fabrics during the laundry process. EDDS can be used as a replacement for all or part of the non-biodegradable phosphonate chelants currently used in many existing laundry products, thereby yielding detergent formulations having reduced phosphorus content and which have greater biodegradability than many of those currently in use.

Recently, in some geographical areas, there has been a growning concern regarding the use of phosphorus-containing compounds in laundry detergent compositions because of some evidence that links such compounds to the eutrophication of lakes and streams. While it is not clear whether or not this link is really significant, some governmental bodies have begun to restrict the phosphorus content of detergent compositions, necessitating the formulation of laundry detergents containing chelants less effective than the conventionally-used phosphonates or polyphosphonates. These requirements have complicated the formulation of effective and appropriately priced laundry detergent compositions. It would, therefore, be highly desirable to be able to formulate detergent compositions which include reduced levels of phosphorous-containing components and are, at least, partially biodegradable, but which still exhibit excellent cleaning and stain removal performance.

In addition, while the use of chelants in detergent compositions is generally thought to be desirable for enhanced stain removal, there is generally thought to be an efficacy/biodegrability trade-off with chelants. For example, the chelants which provide the best stain removal (e.g., diethylenetriaminepentaacetates) tend to be totally non-biodegradable, while those which exhibit some level of biodegradability (e.g., N-(2-hydroxyethyl)aspartic acid) are relatively poor in terms of stain removal.

It is an object of the present invention to provide laundry detergent compositions containing a nil-phosphorus, biodegradable chelant, that possess excellent stain removal characteristics.

BACKGROUND ART

The use of aminopolycarboxylates as laundry detergent additives is generally disclosed in the art. For example, the priro art described laundry detergent compositions which include nitrilotriacetates (NTA), ethylendediaminetetraacetates (EDTA). diethylenetriaminepentaacetates (DTPA), and hydroxyethylethylenediaminetriacetates (HEDTA), and triethylenetetraminehexaacetic acid (TTHA).

U.S. Pat. No. 4,560,491, Curry and Edwards, issued Dec. 24, 1985, discloses laundry detergent compositions, essentially free of phosphate detergency builders, containing an aluminosilicate or organic detergency builder and from about 0.5% to about 10% by weight of the chelant, HEDTA. The list of suitable organic detergency builders disclosed includes aminopolycarboxylates, such as NTA, EDTA and DTPA. Examples I and II disclose liquid detergent compositions containing DTPA and HEDTA. Example III disclosed a granular detergent composition containing NTA and HEDTA.

U.S. Pat. No. 4,397,776, Ward, issued Aug. 9, 1983, discloses liquid laundry detergent compositions, having a pH between 9 and 13, containing alpha-amine oxide surfactants and from about 0.01% to about 25% by weight of a heavy-metal chelating agent. The chelating agent sequesters heavy-metal ions and thus enhances the stability of the alpha-amine oxides. The preferred chelating agents include aminopolycarboxylates, such as NTA, EDTA, DTPA, and HEDTA.

U.S. Pat. No. 3,920,564, issued Nov. 18, 1975, discloses softener/detergent formulations containing surfactants, quaternary ammonium or diamine fabric softeners, and a builder salt selected from aminopolycarboxylates and/or sodium citrate. Examples of suitable aminopolycarboxylates include NTA, EDTA and HEDTA.

U.S. Pat. No. 3,151,084, Schiltz et al, issued Sept. 29, 1964, discloses alkylbenzenesulfonate-containing detergent compositions in which solubility is said to be improved by the addition of 0.25%–4% of a mixture of EDTA and a solubilizing agent selected from salts of N,N-di(2-hydroxyethyl) glycine, iminodiacetic acid, NTA and HEDTA.

U.S. patent application Ser. No. 880,605, Lewis, filed June 30, 1986, discloses laundry detergent compositions, essentially free of peroxygen bleach compounds, containing a surfactant, a builder, and from about 0.3% to about 10% by weight of the chelant, TTHA. Example 1 discloses granular detergent compositions containing NTA, EDTA, DTPA and TTHA.

None of these patents or applications disclose detergent compositions which contain EDDS. Moreover, the aminopolycarboxylates disclosed in those patents or applications are not biodegradable.

The art also discloses methods of synthesizing EDDS. For example, U.S. Pat. No. 3,158,635, Kezerian and Ramsey, issued Nov. 24, 1964, discloses methods of preparing compounds having the formula:

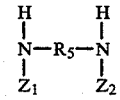

wherein $Z_1$ and $Z_2$ are the same or different bis-adduction residues of unsaturated polycarboxylic acids and salts thereof, and $R_5$ is an alkylene or alkylene-phenylene group. These compounds are taught to be useful for removing rust and oxide coating from metals. If

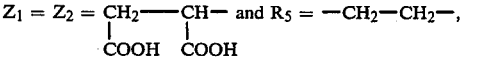

then the compound is EDDS. Example 1 discloses a method of synthesizing EDDS from maleic anhydride and ethylenediamine.

Springer and Kopecka, Chem. Zvesti. 20(6): 414–422 (1966) (CAS abstract 65:11738f), discloses a method for synthesizing EDDS and describes the formation of EDDS complexes with heavy metals. Stability constants were determined for the complexes of EDDS with $Cu^{2+}$, $Co^{3+}$, $Ni^{2+}$, $Fe^{3+}$, $Pb^{2+}$, $Zn^{2+}$, and $Cd^{2+}$.

Pavelcik and Majer, Chem. Zvesti. 32(1): 37–41 (1978) (CAS abstract 91(5): 38875f), describes the preparation and properties of the meso and racemate stereoisomer forms of EDDS. The meso and racemate forms were separated via their Cu(II) complexes, with the racemate form being identified from crystallographic data. These compounds are taught to be useful as selective analytical titration agents.

None of these references disclose the compositions of the present invention or recognize the unique fabric stain removal and biodegradability properties of EDDS in the context of laundry detergent compositions.

SUMMARY OF THE INVENTION

The compositions of this invention are laundry detergents comprising (a) from about 1% to about 75% by weight of a detergent surfactant selected from the group consisting of anionic surfactants, nonionic surfactants, zwitterionic surfactants, ampholytic surfactants, cationic surfactants, and mixtures thereof; (b) from about 5% to about 80% by weight of a detergency builder; and (c) from about 0.1% to about 10% by weight of ethylene-diamine-N,N'-disuccinic acid, or alkali metal, alkaline earth, ammonium or substituted ammonium salts thereof, or mixtures thereof.

DETAILED DESCRIPTION OF THE INVENTION

The components of the present invention are described in detail below.

Detergent Surfactant

The amount of detergent surfactant included in the detergent compositions of the present invention can vary from about 1% to about 75% by weight of the composition depending upon the particular surfactant(s) used, the type of composition to be formulated (e.g., granular, liquid, concentrate, full strength) and the effects desired. Preferably, the detergent surfactant(s) comprises from about 10% to about 60% by weight of the composition. The detergent surfactant can be nonionic, anionic, ampholytic, zwitterionic, or cationic. Mixtures of these surfactants can also be used.

A. Nonionic Surfactants

Suitable nonionic surfactants are generally disclosed in U.S. Pat. No. 3,929,678, Laughlin et al., issued Dec. 30, 1975, at column 13, line 14 through column 16, line 6, incorporated herein by reference. Classes of useful nonionic surfactants include:

1. The polyethylene oxide condensates of alkyl phenols. These compounds include the condensation products of alkyl phenols having an alkyl group containing from about 6 to about 12 carbon atoms in either a straight chain or branched chain configuration with ethylene oxide, the ethylene oxide being present in an amount equal to from about 5 to about 25 moles of ethylene oxide per mole of alkyl phenol. Examples of compounds of this type include nonyl phenol condensed with about 9.5 moles of ethylene oxide per mole of phenol; dodecyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal CO-630, marketed by the GAF Corporation; and Triton X-45, X-114, X-100, and X-102, all marketed by the Rohm and Haas Company.

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 4 to about 10 moles of ethylene oxide per mole of alcohol. Examples of such ethoxylated alcohols include the condensation product of myristyl alcohol with about 10 moles of ethylene oxide per mole of alcohol; and the condensation product of coconut alcohol (a mixture of fatty alcohols with alkyl chains varying in length from 10 to 14 carbon atoms) with about 9 miles of ethylene oxide. Examples of commercially available nonionic surfactants of this type include Tergitol 15-S-9 (the condensation product of $C_{11}$–$C_{15}$ linear alcohol with 9 moles ethylene oxide), marketed by Union Carbide Corporation; Neodol 45-9 (the condensation product of $C_{14}$–$C_{15}$ linear alcohol with 9 moles of ethylene oxide), Neodol 23-6.5 (the condensation product of $C_{12}$–$C_{13}$ linear alcohol with 6.5 moles of ethylene oxide), Neodol 45-7 (the condensation product of $C_{14}$–$C_{15}$ linear alcohol with 7 moles of ethylene oxide), Neodol 45-4 (the condensation product of $C_{14}$–$C_{15}$ linear alcohol with 4 moles of ethylene oxide), marketed by Shell Chemical Company, and Kyro EOB (the condensation product of $C_{13}$–$C_{15}$ linear alcohol with 9 moles ethylene oxide), marketed by The Procter & Gamble Company.

3. The condensation products of ethylene oxide with a hydrophobic base formed by the condensation of propylene oxide with propylene glycol. The hydrophobic portion of these compounds has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

5. Semi-polar nonionic surfactants, which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred semi-polar nonionic detergent surfactants are the amine oxide surfactants having the formula $$R^3(OR^4)_xN\overset{O}{\uparrow}R^5_2$$

wherein $R^3$ is an alkyl, hydroxyalky, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

Preferred amine oxide surfactants are $C_{10}$–$C_{18}$ alkyl dimethyl amine oxides and $C_8$–$C_{12}$ alkoxy ethyl dihydroxy ethyl amine oxides.

6. Alkylpolysaccharides disclosed in U.S. Pat. No. 4,565,647, Llenado, issued Jan. 21, 1986, having a hydrophobic group containing from about 6 to about 30 carbon atoms, preferably from abut 10 to about 16 carbon atoms and a polysaccharide, e.g., a polyglycoside, hydrophilic group containing from about 1½ to about 10, preferably from about 1½ to about 3, most preferably from about 1.6 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the 1-position of the additional saccharide units and the 2-, 3-, 4-, and/or 6- positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galatoses. Suitable mixtures include coconut alkyl, di-, tri-, tetra-, and pentaglucosides and tallow alkyl tetra-, penta0, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1½ to about 10, preferably from about 1½ to about 3, most preferably from about 1.6 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

7. Fatty acid amide surfactants having the formula:

$$R^6-\overset{O}{\overset{\|}{C}}-NR^7_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3.

Preferred amides are $C_8$–$C_{20}$ ammonia amides, monoethanolamides, diethanolamides, and isopropanolamides.

B. Anionic Surfactants

Anionic surfactants suitable for use in the present invention are generally disclosed in U.S. Pat. No. 3,929,678, Laughlin et al., issued Dec. 30, 1975, at column 23, line 58 through column 29, line 23, incorporated herein by reference. Classes of useful anionic surfactants include:

1. Ordinary alkali metal soaps, such as the sodium, potassium, ammonium and alkylolammonium salts of higher fatty acids containing from about 8 to about 24 carbon atoms, preferably from about 10 to about 20 carbon atoms. Preferred alkali metal soaps are sodium laurate, sodium stearate, sodium oleate and potassium palmitate.

2. Water-soluble salts, preferably the alkali metal, ammonium and alkylolammonium salts, or organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.)

Examples of this group of anionic surfactants are the sodium and potassium alkyl sulfates, especially those obtained by sulfating the higher alcohols ($C_8$–$C_{18}$ carbon atoms), such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. No. 2,220,099, Guenther et al., issued Nov. 5, 1940, and U.S. Pat. No. 2,477,383, Lewis, issued Dec. 26, 1946. Especially useful are linear straight chain alkylbenzene sulfonates in which the average number of carbon atoms in the alkyl group is from about 11 to about 13, abbreviated as $C_{11}$–$C_{13}$LAS.

Another group of preferred anionic surfactants of this type are the alkyl polyethoxylate sulfates, particularly those in which the alkyl group contains from about 10 to about 22, preferably from about 12 to about 18 carbon atoms, and wherein the polyethoxylate chain contains from about 1 to about 15 ethoxylate moieties, preferably from about 1 to about 3 ethoxylate moieties. These anionic detergent surfactants are particularly desirable for formulating heavy-duty liquid laundry detergent compositions.

Other anionic surfactants of this type include sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Also included are water-soluble salts of esters of alpha-sulfonated fatty acids containing from about 6 to about 20 carbon atoms in the fatty acid group and from about 1 to about 10 carbon atoms in the ester group; water-soluble salts of 2-acyloxy-alkane-1-sulfonic acids containing from about 2 to about 9 carbon atoms in the acyl group and from about 9 to about 23 carbon atoms in the alkane moiety; alkyl ether sulfaces containing from about 10 to about 20 carbon atoms in the alkyl group and from about 1 to about 30 moles of ethylene oxide; water-soluble salts of olefin sulfonates containing from about 12 to about 24 carbon atoms; and beta-alkyloxy alkane sulfonates containing from about 1 to about 3 carbon atoms in the alkyl group and from about 8 to about 20 carbon atoms in the alkane moiety.

Particularly preferred surfactants for use herein include alkyl benzene sulfonates, alkyl sulfates, alkyl polyethoxy sulfates and mixtures thereof. Mixtures of these anionic surfactants with a nonionic surfactant selected from the group consisting of $C_{10}$–$C_{20}$ alcohols ethoxylated with an average of from about 4 to about 10 moles of ethylene oxide per mole of alcohol are particularly preferred.

3. Anionic phosphate surfactants.

4. N-alkyl substituted succinamates.

C. Ampholytic Surfactants

Ampholytic surfactants can be broadly described as aliphatic derivatives of secondary or tertiary amines, or aliphatic derivatives of heterocyclic secondary and tertiary amines in which the aliphatic radical can be straight or branched chain and wherein one of the aliphatic substituents contains from about 8 to about 18 carbon atoms and at least one of the aliphatic substituents contains an anionic water-solubilizing group, e.g., carboxy, sulfonate, sulfate. See U.S. Pat. No. 3,929,678, Laughlin et al., issued Dec. 30, 1975, column 19, line 38 through column 22, line 48, incorporated herein by reference, for examples of ampholytic surfactants useful herein.

D. Zwitterionic Surfactants

Zwitterionic surfactants can be broadly described as derivatives of secondary and teriary amines, derivatives of heterocyclic secondary and tertiary amines, or derivatives of quaternary ammonium, quaternary phosphonium or tertiary sulfonium compounds. See U.S. Pat. No. 3,929,678, Laughlin et al., issued Dec. 30, 1975, column 19, line 38 through column 22, line 48, incorporated herein by reference, for examples of zwitterionic surfactants useful herein.

E. Cationic Surfactants

Cationic surfactants can also be included in detergent compositions of the present invention. Cationic surfactants comprise a wide variety of compounds characterized by one or more organic hydrophobic groups in the cation and generally by a quaternary nitrogen associated with an acid radial. Pentavalent nitrogen ring compounds are also considered quaternary nitrogen compounds. Suitable anions are halides, methyl sulfate and hydroxide. Tertiary amines can have characteristic similar to cationic surfactants at washing solutions pH values less than about 8.5.

Suitable cationic surfactants include the quaternary ammonium surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain; each $R^3$ is independently selected from the group consisting of $—CH_2CH_2—$, $—CH_2CH(CH_3)—$, $—CH_2CH(CH_2OH)—$, and $—CH_2CH_2CH_2—$; each $R^4$ is independently selected from the group consisting of $C_1$–$C_4$ alkyl, $C_1$–$C_4$ hydrozyalkyl, benzyl, ring structures formed by joining the two $R^4$ groups, $—CH_2CHOHCHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Preferred examples of the above compounds are the alkyl quaternary ammonium surfactants, especially the mono-long chain alkyl surfactants described in the above formula when $R^5$ is selected from the same groups as $R^4$. The most preferred quaternary ammonium surfactants are the chloride, bromide and methylsulfate $C_8$–$C_{16}$ alkyl trimethylammonium salts, $C_8$–$C_{16}$ alkyl di(hydroxyethyl)methylammonium salts, the $C_8$–$C_{16}$ alkyl hydroxyethyldimethylammonium salts, and $C_8$–$C_{16}$ alkyloxypropyltrimethylammonium salts. Of the above, decyl trimethylammonium methylsulfate, lauryl trimethylammonium chloride, myristyl trimethylammonium bromide and coconut trimethylammonium chloride and methylsulfate are particularly preferred.

A more complete disclosure of cationic surfactants useful herein can be found in U.S. Pat. No. 4,228,044. Cambre, issued Oct. 14, 1980, incorporated herein by reference.

Ethylenediamine-N,N'-disuccinic Acid or Salts Thereof

The compositions of the invention contain, as an essential component, from about 0.1% to about 10%, preferably from about 1% to about 5%, of ethylenediamine-N,N'-disuccinic acid (EDDS) or the alkali metal, alkaline earth metal, ammonium, or substituted ammonium salts thereof, or mixtures thereof. Preferred EDDS compounds for granular detergent compositions are the free acid form and the sodium salt thereof. Examples of such preferred sodium salts of EDDS include NaEDDS, $Na_2$EDDS and $Na_4$EDDS. Preferred EDDS compounds for liquid detergent compositions are the free acid form and the ammonium or potassium salts thereof.

The structure of the acid form of EDDS is as follows.

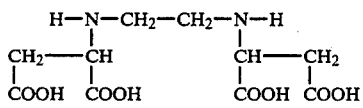

EDDS can be synthesized, for example, from readily available, inexpensive starting materials, such as maleic anhydride and ethylenediamine, as follows.

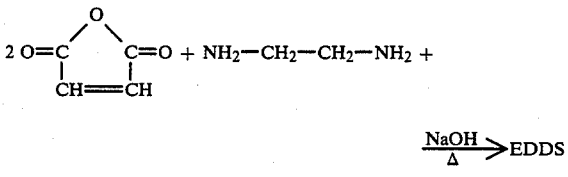

A more complete disclosure of methods for synthesizing EDDS from commercially available starting materials can be found in U.S. Pat. No. 3,158,635, Kezerian and Ramsey, issued Nov. 24, 1964, incorporated herein by reference.

The synthesis of EDDS from maleic anhydride and ethylenediamine yields a mixture of three optical isomers, [R,R], [S,S], and [S,R], due to the two asymmetric carbon atoms. The biodegradation of EDDS appears to be optical isomer-specific, with the [S,S] isomer degrading most rapidly and extensively.

The [S,S] isomer of EDDS can be synthesized from L-aspartic acid and 1,2-dibromethane, as follows.

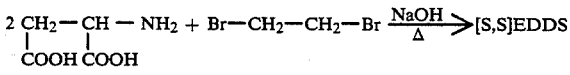

A more complete disclosure of the reaction of L-aspartic acid with 1,2-dibromethane to form the [S,S] isomer of EDDS can be found in Neal and Rose, Stereospecific Ligands and Their Complexes of Ethylenediamine-disuccinic Acid, *Inorganic Chemistry*, Vol. 7. (1968), pp. 2405–2412, incorporated herein by reference.

The chelant, EDDS, possesses a unique combination of stain removal and biodegradability properties. EDDS is the first biodegradable chelant found that provides stain removal performance equivalent or superior to that of chelants (e.g., EDTA and DTPA) currently used in many existing laundry products. By using EDDS as a replacement for these chelants, it is now possible to formulate detergent compositions which contain reduced levels of phosphorous-containing components and are biodegradable, but which still exhibit excellent cleaning and stain removal performance.

Without being bound by theory, it is believed that ethylenediamine-N,N'-disuccinic acid or its salts, which are contained in the compositions of the present invention, act to chelate metals such as iron, manganese and copper and other multivalent metal ions which are constituents of certain organic stains or which act to stabilize such stains when present in the washing solution. This, in turn, makes the stains easier to remove from the fabrics.

Detergent Builders

Detergent compositions of the present invention contain inorganic and/or organic detergent builders to assist in mineral hardness control. These builders comprise from about 5% to about 80% by weight of the compositions. Built liquid formulations preferably comprise from about 10% to about 30% by weight of detergent builder, while built granular formulations preferably comprise from about 10% to about 50% by weight of detergent builder.

Suitable detergent builders include crystalline aluminosilicate ion exchange materials having the formula:

$$Na_z[(AlO_2)_z(SiO_2)_y].xH_2O$$

wherein z and y are at least about 6, the mole ratio of z to y is from about 1.0 to about 0.5; and x is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2, and y is 1; this material having a magnesium ion exchange capacity of at least about 50 milligram equivalents of $CaCO_3$ hardness per gram of anhydrous aluminosilicate.

The aluminosilicate ion exchange builder materials are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The preferred crystalline aluminosilicate ion exchange materials are further characterized by a particle size diameter of from about 0.1 micron to about 10 microns. Amorphous materials are often smaller, e.g., down to less than about 0.01 micron. More preferred ion exchange materials have a particle size diameter of from about 0.2 micron to about 4 microns. The term "particle size diameter" represents the average particle size diameter of a given ion exchange material as determined by conventional analytical techniques such as, for example, microscopic determination utilizing a scanning electron microscope. The crystalline aluminosilicate ion exchange materials are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq./g. to about 352 mg. eq./g. The aluminosilicate ion exchange materials are still further characterized by their calcium ion exchange rate which is at least about 2 grains $Ca^{++}$/gallon/- minute/gram/gallon of aluminosilicate (anhydrous basis), and generally lies within the range of from about 2 grains/gallon/ minute/gram/gallon to about 6 grains/gallon/minute/gram/gallon, based on calcium ion hardness. Optimum aluminosilicates for builder purposes exhibit a calcium ion exchange rate of at least about 4 grains/gallon/minute/gram/gallon.

The amorphous aluminosilicate ion exchange materials usually have a $Mg^{++}$ exchange capacity of at least about 50 mg. eq. $CaCO_3$ /g. (12 mg. $Mg^{++}$/g.) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful herein are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al., issued Oct. 12, 1976, incorporated herein by reference. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula $$Na_{12}[(AlO_2)_{12}(SiO_2)_{12}].xH_2O$$

wherein x is from about 20 to about 30, especially about 27.

Other detergency builders useful in the present invention include the alkali metal silicates, alkali metal carbonates, phosphates, polyphosphates, phosphonates, polyphosphonic acids, $C_{10-18}$ alkyl monocarboxylic acids, polycarboxylic acids, alkali metal ammonium or substituted ammonium salts thereof and mixtures thereof. Preferred are the alkali metal, especially sodium, salts of the above.

Specific examples of inorganic phosphate builders are sodium or potassium tripolyphosphate, sodium or potassium pyrophosphate, sodium or potassium polymeric metaphosphate having a degree of polymerization of from about 6 to about 21, and sodium or potassium orthophosphate. Examples of polyphosphonate builders are the sodium and potassium salts of ethylene-1, 1-diphosphonic acid, the sodium and potassium salts of ethane-1-hydroxy-1,1-diphosphonic acid, and the sodium and potassium salts of ethane-1,1,2-triphosphonic acid. Other suitable phosphorus builder compounds are disclosed in U.S. Pat. No. 3,159,581, Diehl, issued Dec. 1, 1964; U.S. Pat. No 3,213,030, Diehl, issued Oct. 19, 1965; U.S. Pat. No. 3,400,148, Quimby, issued Sept. 3, 1968; U.S. Pat. No. 3,400,176, Quimby, issued Sept. 3, 1968; U.S. Pat. 3,422,021, Roy, issued Jan. 14, 1969; and U.S. Pat. No. 3,422,137, Quimby, issued Sept. 3, 1968; all herein incorporated by reference. However, while suitable for use in compositions of the invention, one of the advantages of the present invention is that effective detergent compositions can be formulated using minimum levels or in the complete absence of phosphonates and phosphates.

Examples of nonphosphorus, inorganic builders are sodium or potassium carbonate, sodium or potassium bicarbonate, sodium or potassium sesquicarbonate, sodium or potassium tetraborate decahydrate, and sodium or potassium silicate having a mole ratio of $SiO_2$ to alkali metal oxide of from about 0.5 to about 4.0, preferably from about 1.0 to about 2.4.

Useful water-soluble, nonphosphorus organic builders include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citric acid. For purposes of defining the invention, the organic detergent builder component which may be used herein does not comprise ethylenediamine-N,N'-disuccinic acid (EDDS) or its salts.

Highly preferred polycarboxylate builders are disclosed in U.S. Pat. No. 3,308,067, Diehl, issued Mar. 7, 1967, incorporated herein by reference. Such materials include the water-soluble salts of homo- and copolymers of aliphatic carboxylic acids, such as maleic acid, itaconic acid, mesaconic acid, fumaric acid, aconitic acid, citraconic acid and methylenemalonic acid.

Other builders include the carboxylated carbohydrates disclosed in U.S. Pat. Nos. 3,723,322, Diehl, issued Mar. 28, 1973, incorporated herein by reference.

A class of useful phosphorus-free detergent builder materials have been found to be ether polycarboxylates. A number of ether polycarboxylates have been disclosed for use as detergent builders. Examples of useful ether polycarboxylates include oxydisuccinates, as disclosed in Berg, U.S. Pat. No. 3,128,287, issued Apr. 7, 1964, and Lamberti et al, U.S. Pat. No. 3,635,830, issued Jan. 18, 1972, both of which are incorporated herein by reference.

A specific type of ether polycarboxylates useful as builders in the present invention are those having the general formula:

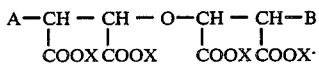

wherein A is H or OH; B is H or

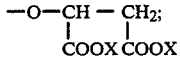

and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is

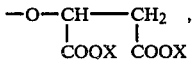

then the compound is tartrate disuccinic acid (TDS) and its water-soluble salts. Mixtures of these builders are especially preferred for use herein. Particularly preferred are mixtures of TMS and TDS is a weight ratio of TMS to TDS of from about 97:3 to about 20:80. A more complete disclosure of these ether polycarboxylates is contained in U.S. Ser. No. 823,909, filed Jan. 30, 1986, Bush et al., incorporated herein by reference.

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Other useful detergency builders include the ether hydroxypolycarboxylates represented by the structure:

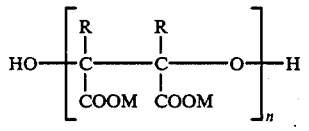

wherein M is hydrogen or a cation wherein the resultant salt is water soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen). A more complete disclosure of these ether polycarboxylates is contained in U.S. Ser. No. 754,560, filed July 11, 1985, Bush et al., incorporated herein by reference.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference. Other useful builders include the $C_5$–$C_{20}$ alkyl succinic acids and salts thereof. A particularly preferred compound of this type is dodecenylsuccinic acid.

Useful builders also include sodium and potassium carboxymethyloxymalonate, carboxymethyloxysuccinate, cis-cyclohexanehexacarboxylate, cis-cyclopentanetetracarboxylate phloroglucinol trisulfonate, water-soluble polyacrylates (having molecular weights of from about 2,000 to about 200,000, for example), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Especially useful detergency builders include the $C_{10}$–$C_{18}$ alkyl monocarboxylic (fatty) acids and salts thereof. These fatty acids can be derived from animal and vegetable fats and oils, such as tallow, coconut oil and palm oil. Suitable saturated fatty acids can also be synthetically prepared (e.g., via the oxidation of petroleum or by hydrogenation of carbon monoxide via the Fisher-Tropsch process). Paricularly preferred $C_{10}$–$C_{18}$ alkyl monocarboxylic acids are saturated coconut fatty acids, palm kernel fatty acids, and mixtures thereof.

Other useful detergency builder materials are the "seeded builder" compositions disclosed in Belgian Pat. No. 798,856, published Oct. 29, 1973, incorporated herein by reference. Specific examples of such seeded builder mixtures are 3:1 wt. mixtures of sodium carbonate and calcium carbonate having 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

Optional Detergent Ingredients

Other optional ingredients which can be included in detergent compositions of the present invention, in their conventional art-established levels for use (generally from 0 to about 20% of the detergent composition), include solvents, hydrotropes, solubilizing agents, processing aids, soil-suspending agents, corrosion inhibitors, dyes, fillers, optical brighteners, germicides, pH-adjusting agents (monoethanolamine, sodium carbonate, sodium hydroxide, etc.), enzymes, enzyme-stabilizing agents, perfumes, fabric softening components, static control agents, bleaching agents, bleach activators, bleach stabilizers and the like.

Materials that provide clay soil removal/anti-redeposition benefits can also be incorporated in the detergent compositions of the invention and are particularly useful in liquid compositions of the invention. These clay soil removal/anti-deposition agents are usually included at from about 0.1% to about 10% by weight of the composition.

One group of preferred clay soil removal/anti-redposition agents are the ethoxylated amines disclosed in U.S. Pat. No. 4,597,898, Vander Meer, issued July 1, 1986, incorporated herein by reference. Another group of preferred clay soil removal/anti-redeposition agents are the cationic compounds disclosed in European Patent Application No. 111,965, Oh and Gosselink, published June 27, 1984, incorporated herein by reference. Other clay soil removal/anti-redeposition agents which can be used include the ethoxylated amine polymers disclosed in European Patent Application No. 111,984, Gosselink, published June 27, 1984; the zwitterionic compounds disclosed in European Patent Application No. 111,976, Rubingh and Gosselink, published June 27, 1984; the zwitterionic polymers disclosed in European Patent Application No. 112,592, Gosselink, published July 4, 1984; and the amine oxides disclosed in U.S. Pat. No. 4,548,744, Connor, issued Oct. 22, 1985, all of which are incorporated herein by reference.

Soil release agents, such as those disclosed in the art to reduce oily staining of polyester fabrics, may also be used in the compositions of the present invention. U.S. Pat. No. 3,962,152, issued June 8, 1976, Nicol et al., incorporated herein by reference, discloses copolymers of ethylene terephthalate and polyethylene oxide terephthalate as soil release agents. U.S. Pat. No. 4,174,305, issued Nov. 13, 1979, Burns et al., incorporated herein by reference, discloses cellulose ether soil release agents. U.S. Ser. No. 801,020, filed Nov. 22, 1985, Gosselink, incorporated herein by reference, discloses block polyester compounds useful as soil release agents in detergent compositions.

Detergent Formulations

Granular detergent compositions embodying the present invention can be formed by conventional techniques, i.e., by slurrying the individual components in water and then atomizing and spray-drying the resultant mixture, or by pan or drum agglomeration of the ingredients. Granular formulations preferably comprise from about 5% to about 40% of detergent surfactant selected from the group consisting of anionic surfactants, nonionic surfactants, and mixtures thereof.

Liquid compositions of the present invention can contain water and other solvents. Low molecular weight primary or secondary alcohols, exemplified by methanol, ethanol, propanol, and isopropanol, are suitable. Monohydric alcohols are preferred for solubilizing the surfactant, but polyols containing from about 2 to about 6 carbon atoms and from about 2 to about 6 hydroxy groups can be used and can provide improved enzyme stability (if enzymes are included in the composition). Examples of polyols include propylene glycol, ethylene glycol, glycerine and 1,2-propanediol. Ethanol is a particularly preferred alcohol.

The liquid compositions preferably comprise from about 10% to about 60% of detergent surfactant, about 10% to about 30% of builder and about 1.5% to about 5% ethylenediamine-N,N'-disuccinic acid or salts thereof.

Useful detergency builders in liquid compositions include the alkali metal silicates, alkali metal carbonates, polyphosphonic acids, $C_{10}$–$C_{18}$ alkyl monocarboxylic acids, polycarboxylic acids, alkali metal, ammonium or substituted ammonium salts thereof, and mixtures thereof. Preferred liquid compositions contain from about 10% to about 28% of detergency builders selected from the group consisting of $C_{10}$–$C_{18}$ alkyl monocarboxylic acids, polycarboxylic acids and mixtures thereof.

Particularly, preferred liquid compositions contain from about 10% to about 18% of a $C_{10}$–$C_{18}$ monocarboxylic (fatty) acid and from about 0.2% to about 10% of a polycarboxylic acid, preferably citric acid, and provide a solution pH of from about 6 to about 10 at 1.0% concentration in water.

Preferred liquid compositions are substantially free of inorganic phosphates or phosphonates. As used in this context "substantially free" means that the liquid compositions contain less than about 0.5% by weight of an inorganic phosphate- or phosphonate-containing compound.

The detergent compositions of the invention are particularly suitable for laundry use, but are also suitable for the cleaning of hard surfaces and for dishwashing.

In a laundry method aspect of the invention, typical laundry wash water solutions comprise from about 0.1% to about 2% by weight of the detergent compositions of the invention. Fabrics to be laundered are agitated in these solutions to effect cleaning and stain removal.

All parts, percentages and ratios herein are by weight unless otherwise specified. The following non-limiting examples illustrate the present invention.

EXAMPLE 1

Stain removal characteristics of detergent compositions containing EDDS were compared to those of similar compositions containing EDTA, a non-biodegradable chelant, structurally similar to EDDS.

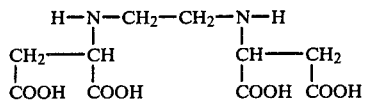

EDDS

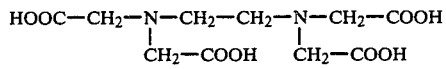

EDTA

A granular detergent composition was prepared by mixing the following ingredients in water and then spray drying the resultant mixture.

| | |
|---|---|
| $C_{12}$ linear alkylbenzene sulfonate | 3.5% (by wt. after spray drying) |
| Tallow alkyl sulfate | 5.5 |
| $C_{14}$–$C_{15}$ alkyl ethoxylate - 2.5 | 5.5 |
| Sodium tripolyphosphate | 33.7 |
| Silicate ($SiO_2/Na_2O$ ratio = 1.6 to 1) | 4.8 |
| $Na_2CO_3$ | 10.5 |
| $Na_2SO_4$ | 25.1 |
| Polyethylene glycol (MW = 8000) | 0.4 |
| $H_2O$ and miscellaneous | 11.0 |

The compositions of Example 1 with the levels of EDDS and EDTA as indicated below, were prepared for use in miniature (2 gallon volume) top load automatic washing machines. First, water was added to the washing machines. Next, granular detergent composition was added to the wash water. Then chelant was added to the wash water in an amount sufficient to make the levels of chelant either 3.3% or 6.7% (by weight of the granular detergent composition listed above) as indicated below. Finally, artitically soiled 5"×5" fabrics representing a range of typical consumer stains, as listed below, and also unsoiled ballast fabrics were placed in each washer. The fabrics consisted of colored polyesters, colored cottons and polyester/cotton knits.

Five replicates of each wash treatment were conducted. A balanced complete block paired comparison test design provided for the fabrics representing each stain type, for a given treatment, to be viewed relative to each of the other treatments. The graders provided numerical cleaning difference grades on a nine point scale (−4 through +4) for each such comparison.

Mean scores for each treatment were calculated and are listed in the table below after normalization of the means based on a zero value for Treatment 1 (i.e., the control).

Stain Removal Evaluation

Conditions:
Water Temperature: 95° F.
Water Hardness: 7 gr/gal well water (mixed calcium and magnesium)
Solution pH: 9.8
Fill Level: 1.5 gallons
Total fabric load: 188 g.
Detergent usage: 8.52 g.
Order of Addition: Water, products, fabrics

Treatments

1=Composition of Example 1—no chelant (control)

2=Composition of Example 1+3.3% EDDS (Present Invention)
3=Composition of Example 1+3.3% EDTA
4=Composition of Example 1+6.7% EDDS (Present Invention)
5=Composition of Example 1+6.7% EDTA

| | Stain Removal Grades (mean values) | | | | | |
|---|---|---|---|---|---|---|
| | Treatments | | | | | Least Significant Difference (95% Confidence Level) |
| Soils: | 1 | 2 | 3 | 4 | 5 | |
| Facial Clay | 0.0 | 0.0 | 0.3 | 0.2 | 0.3 | 0.63 |
| Grass | 0.0 | 0.7 | 0.0 | 0.2 | 0.7 | 1.63 |
| Grape Juice | 0.0 | 1.5* | 1.4* | 1.8* | 2.6* | 0.91 |
| Tea | 0.0 | 1.9* | 0.7 | 1.5* | 1.1* | 0.94 |
| Bacon Grease | 0.0 | 1.8* | 1.4* | 2.5* | 1.9* | 0.63 |
| Spaghetti | 0.0 | 0.4 | 0.5* | 0.0 | 0.7* | 0.62 |
| Dingy Towels | 0.0 | 0.3 | 0.7* | 0.2 | 0.0 | 0.52 |
| | | 0.8 | 0.5 | 0.2 | 0.7 | 0.92 |

*Indicates value is significantly different than Treatment 1.

A positive value indicates improvement vs. the control.

The above data show that, in terms of polyphenolic stain removal (e.g., grape juice and tea), an important criteria for measuring stain removal (and, thereby, chelant) performance, compositions containing EDDS or EDTA all substantially outperformed Treatment 1 which did not contain any chelant. At low levels of chelant (i.e., 3.3%), Treatment 2 (EDDS) was equivalent or superior to Treatment 3 (EDTA) in removing grape juice and tea stains. Similarly, at higher levels of chelant (i.e., 6.7%), Treatment 4 (EDDS) was equivalent or superior to Treatment 5 (EDTA) in removing grape juice and tea stains. This example demonstrates at both low and high chelant concentrations, detergent compositions containing EDDS were at least as effective in the removal of chelant sensitive stains as those containing EDTA. In addition, EDDS is, at least partially, biodegradable, whereas EDTA is completely non-biodegradable.

EXAMPLE II

Heavy duty, granular detergent compositions are prepared by spray drying a water slurry of the following components, listed in the stated proportions (by weight after spray drying).

| | A | B |
|---|---|---|
| $C_{13}$ linear alkylbenzene sulfonate | 8.75% | 10.0% |
| $C_{14}$–$C_{15}$ alkyl sulfate | 8.75 | — |
| $C_{14}$–$C_{16}$ alkyl sulfate | — | 10.0 |
| Topped $C_{12}$–$C_{13}$ alkyl ethoxylate - 6.5 | 0.5 | 1.2 |
| Toluene | 0.5 | — |
| Sodium tripolyphosphate | 38.2 | — |
| Aluminosilicate (Zeolite A) | — | 11.7 |
| Ethylenediamine-N,N'—disuccinic acid | 3.0 | 3.0 |
| Sodium carbonate | 15.8 | 17.5 |
| Silicate ($SiO_2/Na_2O$ ratio = 1.6 to 1) | 5.3 | — |
| Sodium sulfate | 12.1 | 40.0 |
| Polyethylene glycol (MW = 8000) | 0.5 | 1.2 |
| Polyacrylate | 1.0 | 3.5 |
| Water, perfume, colorants, fabric whiteners, bleaching agents, and other miscellaneous ingredients | Balance | Balance |

The compositions of Example II, when used to launder fabrics, provide excellent stain removal and cleaning performance.

EXAMPLE III

Heavy duty, nil phosphorus, liquid detergent compositions are prepared by adding the compositions together in the stated proportions with continuous mixing and adjustment of the pH to about 8 through the addition of NaOH.

| | A | B |
|---|---|---|
| $C_{12}$ linear alkylbenzene sulfonic acid | — | 10.25% |
| $C_{13}$ linear alkylbenzene sulfonic acid | 8.0% | — |
| $C_{14}$–$C_{15}$ alkyl ethoxylate-2.25 sulfuric acid | 12.0 | — |
| Topped $C_{12}$–$C_{13}$ alkyl ethoxylate - 6.5 | 5.0 | — |
| $C_{14}$–$C_{15}$ alkyl alcohol ethoxylate - 7 | — | 11.62 |
| $C_{12}$ alkyl trimethylammonium chloride | 0.6 | — |
| TEA coconut alkyl sulfate | — | 3.88 |
| $C_{12}$–$C_{14}$ fatty acid | 10.5 | — |
| Citric acid | 3.25 | 0.9 |
| Oleic acid | — | 3.88 |
| Topped whole cut coconut/palm kernel fatty acid | — | 10.68 |
| Ethylenediamine-N,N'—disuccinic acid | 2.25 | 1.7 |
| Water | 27.3 | 38.4 |
| Ethanol | 9.0 | 5.81 |
| 1,2-propanediol | 7.0 | 1.6 |
| KOH | 3.8 | — |
| NaOH | 3.0 | 3.4 |
| Triethanolamine | — | 4.85 |
| Monoethanolamine | 0.5 | — |
| Ethoxylated tetraethylenepentamine | 2.0 | — |
| Soil release polymer | 2.5 | — |
| Perfume, colorants, enzymes, fabric whiteners, bleaching agents, and other miscellaneous ingredients | Balance | Balance |

The compositions of Example III, when used to launder fabrics, provide excellent stain removal and cleaning performance.

In Examples I and II, substantially equivalent results are obtained when the sodium tripolyphosphate component is replaced, in whole or in part, by an equivalent amount of sodium pyrophosphate, crystalline sodium aluminosilicate materials, sodium metaphosphate, sodium orthophosphate, potassium ethylene-1,1-diphosphonate, sodium nitrilotriacetic acid, sodium mellitic acid, sodium oxydisuccinic acid, sodium tartrate disuccinic acid, sodium tartrate monosuccinic acid, potassium dodecenyl-succinate, sodium 3,3-dicarboxy-4-oxa-1,6-hexanedioate, and mixtures thereof.

In Example III (parts A and B) substantially similar results are obtained when the anionic surfactant component is replaced, in whole or in part, with an equivalent amount of $C_{11}$–$C_{13}$ linear alkylbenzene sulfonate, $C_{14}$–$C_{15}$ alkyl ethoxylate -1 sulfate, $C_{14}$–$C_{15}$ alkyl ethoxylate 2.25 sulfate, tallow alkyl sulfate, sodium laurate, sodium stearate, potassium palmitate, and mixtures thereof. Similar results are also obtained when the nonionic surfactant component of Example III (parts A and B) is replaced, in whole or in part, by an equivalent amount of nonyl phenol ethoxylate-9.5, dodecyl phenol ethoxylate-12, myristyl alcohol ethoxylate-10, coconut alcohol ethoxylate-9, $C_{12}$ alkyl dimethyl amine oxide, $C_{10}$ alkoxy ethyl dihydroxy ethylamine oxide, $C_{16}$ ammonia amide, and mixtures thereof. Substantially similar results are also obtained when the detergency builder component is replaced, in whole or in part, with the sodium, potassium, lithium, ammonium and substituted ammonium salts of ethylenediamine tetraacetic acid, nitrilotriacetic acid, oxydissucinic acid, tartrate monosuccinic acid, tartrate disuccinic acid, mellitic acid, citric acid, $C_{10}$–$C_{18}$ alkyl monocarboxylic acids, itaconis acid, mesaconic acid, fumaric acid, aconitic acid, citraconic acid, methylenemalonic acid, and mixtures thereof.

In all of the above examples, substantially similar results are obtained when the EDDS free acid component is replaced, in whole or in part, by an equivalent amount of EDDS sodium salts (e.g., $Na_2$EDDS and $Na_4$EDDS), potassium salts (e.g., $K_2$EDDS and $K_4$EDDS), and ammonium salts (e.g., $(NH_4)_2$ EDDS and $(NH_4)_4$ EDDS).

What is claimed is:

1. A laundry detergent composition comprising:
(a) from about 1% to abut 75% by weight of a detergent surfactant selected from the group consisting of anionic surfactants, nonionic surfactants, zwitterionic surfactants, ampholytic surfactants, cationic surfactants, and mixtures thereof;
(b) from about 5% to about 80% by weight of a detergency builder; and
(c) from about 0.1% to about 10% by weight ethylenediamine-N,N'-disuccinic acid, or alkali metal, alkaline earth, ammonium or substituted ammonium salts thereof, or mixtures thereof.

2. The composition of claim 1 wherein the surfactant component is selected from the group consisting of alkylbenzene sulfonates, alkyl sulfates, alkyl polyethoxy sulfates, and mixtures thereof.

3. The composition of claim 1 wherein the detergency builder component is selected from the group consisting of alkali metal silicates; alkali metal carbonates; alkali metal phosphates; alkali metal polyphosphates; alkali metal phosphonates; alkali metal polyphosphonic acids, $C_{10}$–$C_{18}$ alkyl monocarboxylic acids, polycarboxylic acids, alkali metal, ammonium or substituted ammonium salts thereof; and mixtures thereof.

4. The composition of claim 1 comprising from about 1% to about 5% of ethylenediamine-N,N'-disuccinic acid or alkali metal, alkaline earth, ammonium or substituted ammonium salts thereof, or mixtures thereof.

5. The composition of claim 4 wherein the ethylenediamine-N,N'-disuccinic acid component is selected from the group consisting of ethylenediamine-N,N'-disuccinic acid
free acid; ethylenediamine-N,N'-disuccinic acid sodium salt; and mixtures thereof.

6. The composition of claim 4 wherein the EDDS component is in the form of its [S,S] isomer.

7. The composition of claim 2 wherein the surfactant component additionally comprises a nonionic surfactant selected from the group consisting of $C_{10}$–$C_{20}$ alcohols ethoxylated with an average of from about 4 to about 10 moles of ethylene oxide per mole of alcohol.

8. A liquid laundry detergent composition comprising:
(a) from about 10% to about 60% by weight of a detergent surfactant selected from the group consisting on anionic surfactants, nonionic surfactants, zwitterionic surfactants, ampholytic surfactants, cationic surfactants, and mixtures thereof;
(b) from about 10% to about 30% by weight of a detergency builder selected from the group consisting of alkali metal silicates; alkali metal carbonates; polyphosphonic acids, $C_{10}$–$C_{18}$ alkyl monocarboxylic acids, polycarboxylic acids, alkali metal, ammonium or substituted ammonium salts thereof; and mixtures thereof; and
(c) from about 0.1% to about 10% by weight ethylenediamine-N,N'-disuccinic acid, or alkali metal, alkaline earth, ammonium or substituted ammonium salts thereof, or mixtures thereof.

9. The composition of claim 8 comprising from about 10% to about 28% by weight of a detergency builder selected from the group consisting of $C_{10}$–$C_{18}$ alkyl monocarboxylic acids, polycarboxylic acids, and mixtures thereof.

10. The composition of claim 9 comprising, as the detergency builder, from about 10% to about 18% by weight of a $C_{10}$–$C_{18}$ alkyl monocarboxylic acid, and from about 0.2% to about 10% by weight of citric acid or a salt thereof.

11. The composition of claim 8 wherein the surfactant component is selected from the group consisting of alkylbenzene sulfonates, alkyl sulfates, alkyl polyethoxy sulfates, and mixtures thereof.

12. The composition of claim 8 comprising from about 1.5% to about 5% ethylenediamine-N,N'-disuccinic acid or alkali metal, alkaline earth, ammonium or substituted ammonium salts thereof, or mixtures thereof.

13. The composition of claim 12 wherein the ethylenediamine-N,N'-disuccinic acid component is selected from the group consisting of ethylenediamine-N,N'-disuccinic acid free acid; ethylenediamine-N,N'-disuccinic acid potassium salt; ethylenediamine-N,N'-disuccinic acid ammonium salt; and mixtures thereof.

14. The composition of claim 8 which is substantially free of inorganic phosphates or polyphosphates.

15. The composition of claim 11 wherein the surfactant component additionally comprises a nonionic surfactant selected from the group consisting of $C_{10}$–$C_{20}$ alcohols ethoxylated with an average of from about 4 to about 10 moles of ethylene oxide per mole of alcohol.

16. The composition of claim 8 having a pH of from about 6 to about 10 at 1% concentration in water.

17. A granular laundry detergent composition comprising:
(a) from about 5% to about 40% by weight of a detergent surfactant selected from the group consisting of anionic surfactants, nonionic surfactants, and mixtures thereof;
(b) from about 10% to about 50% by weight of a detergency builder selected from the group consisting of alkali metal silicates; alkali metal carbonates; alkali metal phosphates; alkali metal polyphosphates; alkali metal phosphonates; alkali metal polyphosphonic acids, $C_{10}$–$C_{18}$ alkyl monocarboxylic acids, polycarboxylic acids, alkali metal, ammonium or substituted ammonium salts thereof; and mixtures thereof; and
(c) from about 0.1% to about 10% by weight ethylenediamine-N,N'-disuccinic acid, or alkali metal, alkaline earth, ammonium or substituted ammonium salts thereof, or mixtures thereof.

18. The composition of claim 17 wherein the surfactant component is selected from the group consisting of alkylbenzene sulfonates, alkyl sulfates, alkyl polyethoxy sulfates, and mixtures thereof.

19. The composition of claim 17 which comprises from about 1% to about 5% ethylenediamine-N,N'-disuccinic acid or alkali metal, alkaline earth, ammonium or substituted ammonium salts thereof, or mixtures thereof.

20. The composition of claim 19 wherein the ethylenediamine-N,N'-disuccinic acid component is selected from the group consisting of ethylenediamine-N,N'-disuccinic acid free acid; ethylenediamine-N,N'-disuccinic acid sodium salt; and mixtures thereof,

21. The composition of claim 18 wherein the surfactant component additionally comprises a nonionic surfactant selected from the group consisting of $C_{10}$–$C_{20}$ alcohols ethoxylated with an average of from about 4 to about 10 moles of ethylene oxide per mole of alcohol.

22. A method for laundering fabrics comprising the agitation of said fabrics in an aqueous solution containing from about 0.1% to about 2% of the composition of claim 1.

23. A method for laundering fabrics comprising the agitation of said fabrics in an aqueous solution containing from about 0.1% to about 2% of the composition of claim 8.

24. A method for laundering fabrics comprising the agitation of said fabrics in an aqueous solution containing from about 0.1% to about 2% of the composition of claim 17.

* * * * *